US005542137A

United States Patent [19]

Byfield

[11] Patent Number: 5,542,137

[45] Date of Patent: Aug. 6, 1996

[54] FRICTION FITTED CONTOUR SKIRT FOR MATTRESS PADS AND COVERS

[75] Inventor: Paul C. Byfield, Vancouver, Canada

[73] Assignee: Western Fibres Limited, Vancover, Canada

[21] Appl. No.: 219,500

[22] Filed: Mar. 28, 1994

[51] Int. Cl.[6] ..... A47C 31/00; A47C 21/02

[52] U.S. Cl. ..... 5/500; 5/498; 5/925

[58] Field of Search ..... 5/925, 495, 496, 5/497, 499, 500, 482, 498

[56] References Cited

U.S. PATENT DOCUMENTS

| | | | |
|---|---|---|---|
| 3,205,514 | 9/1965 | Reynolds | 5/925 |
| 4,317,244 | 3/1982 | Balfour-Richie | 5/500 |
| 4,488,323 | 12/1984 | Colburn | 5/496 |
| 4,554,693 | 11/1985 | Calloway | 5/925 |
| 4,962,546 | 10/1990 | Vitale | 5/500 |
| 5,127,115 | 7/1992 | Williams | 5/497 |
| 5,325,555 | 7/1994 | Whitley | 5/497 |

*Primary Examiner*—Flemming Saether
*Attorney, Agent, or Firm*—Oyen Wiggs Green & Mutala

[57] ABSTRACT

A contour skirt for mattress pads or covers and the like is provided with a high friction inner surface to hold the pad or sheet firmly in place on a mattress. Foam material such as polyurethane may be stitched to the inner surface of the skirt in a pattern that produces "puffs" of foam that act as "treads" to grip the mattress. Alternatively, high friction polymeric material such as latex or neoprene may be bonded in strips to the inner surface of the skirt.

5 Claims, 2 Drawing Sheets

FRICTION FITTED CONTOUR SKIRT FOR MATTRESS PADS AND COVERS

FIELD OF THE INVENTION

The invention is in the field of bedding. More particularly, the invention is in the field of mattress pads and covers. The invention provides a contour skirt for mattress pads and covers that includes a high friction inside surface to hold the pad or cover in place on the mattress.

BACKGROUND OF THE INVENTION

Mattress pads and covers are used to protect the outer surface of mattresses and to cushion the user from protruding buttons on the mattress. The pads or covers are generally washable and may be replaced at less cost than replacing the mattress. Previously, such pads have been a flat rectangle of quilted material which was easily displaced under the bed sheets. Consequently a fitted contour skirt has been added in some cases to the pad so that the pad is held in place on the mattress.

A contour skirt is the vertical side portion of a mattress pad or cover that lies against the vertical side portions of a mattress when the pad is in place. The contour skirt is generally held in place against the mattress by means of an elasticated bottom edge, the elasticated edge being designed to cinch in beneath the mattress to hold the pad in place on the mattress. Nonetheless, consumers have been unsatisfied with the inability of these contour covers to stay in place and remain tight on a mattress, which is often covered in a slippery, high lustre ticking.

A number of generally unsatisfactory methods have been tried for holding mattress pads and covers in position on a mattress. For example, elastic corner anchor bands, elasticated contour fitted skirts and draw cords have all been tried. Other approaches involve providing the skirt with multiple elastic threads, or forming the skirt from a stretch fabric. Thus the existing approach has been to provide a tighter fit for the existing linen. The present invention however recognizes that the solution to the problem is to provide a high friction inner surface on the skirt.

SUMMARY OF THE INVENTION

The present invention provides a contour skirt for mattress pads and covers that includes areas of material on its inner surface having a co-efficient of friction higher than the standard cotton linen material from which bedding is made. The contour skirt is held against the mattress by an elasticated lower edge or some alternative means, bringing the high friction surface into contact with the mattress.

The contour skirt of the invention may be made entirely of high friction material. Alternatively, a high friction material may be attached to the inside surface of the material of the contour skirt itself. For example, the high friction material may be an open cell polymeric foam, such as polyurethane. The foam may be attached to the contour skirt by generally horizontal parallel stitch lines.

Alternatively, the high friction material on the inside surface of the skirting may be composed of strips of polymer, such as latex or neoprene. These strips of polymer may be applied to the inside surface of the skirt as a liquid bead and then allowed to dry or cure in place and bond adhesively to the inside surface of the contour skirt. To grip the mattress most effectively, the strips should be generally parallel and horizontally spaced.

It will be understood by those skilled in the art of the invention that the frictional co-efficient of the high friction material that is present on the inner surface of the contour skirt of the invention, must be such that the skirt resists motion along the surface of the mattress, but remains free to be readily removed off the mattress. This functional requirement, along with the requirement that the cover can withstand multiple washings, may be easily understood by those skilled in the art and appropriate materials adopted for use with variations of the invention according to such constraints as the type of mattress surface with which the skirt is intended for use. In particular, it will be understood by those skilled in the art of the invention that a frictional material should be selected that does not render inoperative the means for holding the frictional material against the side of the mattress, where such means is employed.

DETAILED DESCRIPTION OF THE PREFERRED EMBODIMENT

Figure 1:
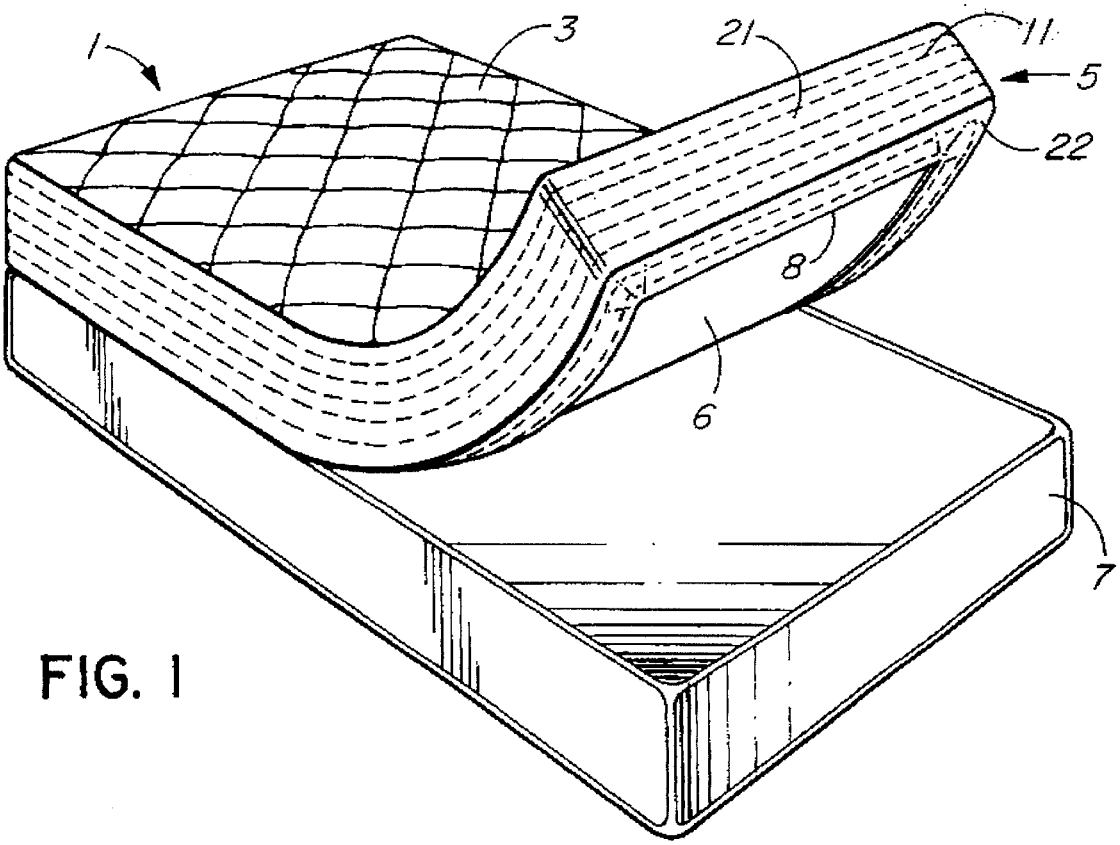
FIG. 1 is an isometric view of a contour skirt of the invention, showing the skirt in place on a mattress and box spring.

FIG. 1 shows a mattress pad 1 of the invention having a quilted pad section 3 and a contour skirt 5 in place on a mattress 6. A portion of the mattress 6 is shown resting on a box spring 7, with a portion of the mattress 6 lifted away from the box spring 7 to show the elasticated inner edge 8 of the contour skirt 5 cinched in under the mattress 6.

The solution to the problem noted above is to provide a high friction surface on the inside surface of the contour skirt 5. While the invention works if the friction surface is applied only to the inner surface of the vertical sides 21 of the skirt, it may also be applied to the horizontal flaps 22. Two methods of applying the friction surface are to affix a layer of open cell foam to the inner surface of the skirt, or to apply a coating to the inner surface of the skirt. In either method, the friction layer or coating must be able to withstand multiple washings.

Figure 2:
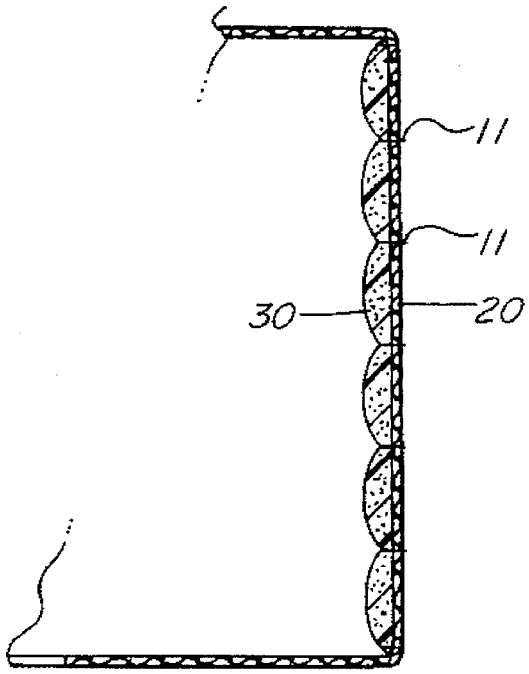
FIG. 2 is a partial cross-sectional view of a contour skirt, showing foam stitched into place on the skirt.

As shown in FIG. 2, in the first embodiment of the invention, the stitching 11 is used to attach a layer of open cell foam polymer 30 to the inside surface of the material, typically linen, of the skirt 20. Stitching 11 in generally horizontal lines is shown on the outside surface of the contour skirt 5. The polymeric foam 30 is preferably polyurethane with a thickness of at least 3/32 inches. The lines of stitching 11 are preferably approximately one inch to approximately two inches apart. This arrangement of stitching 11 causes the portions of foam material 30 between the stitching 11 to bulge outwardly, producing "puffs" of foam that act as "treads" to grip the mattress.

Figure 3:
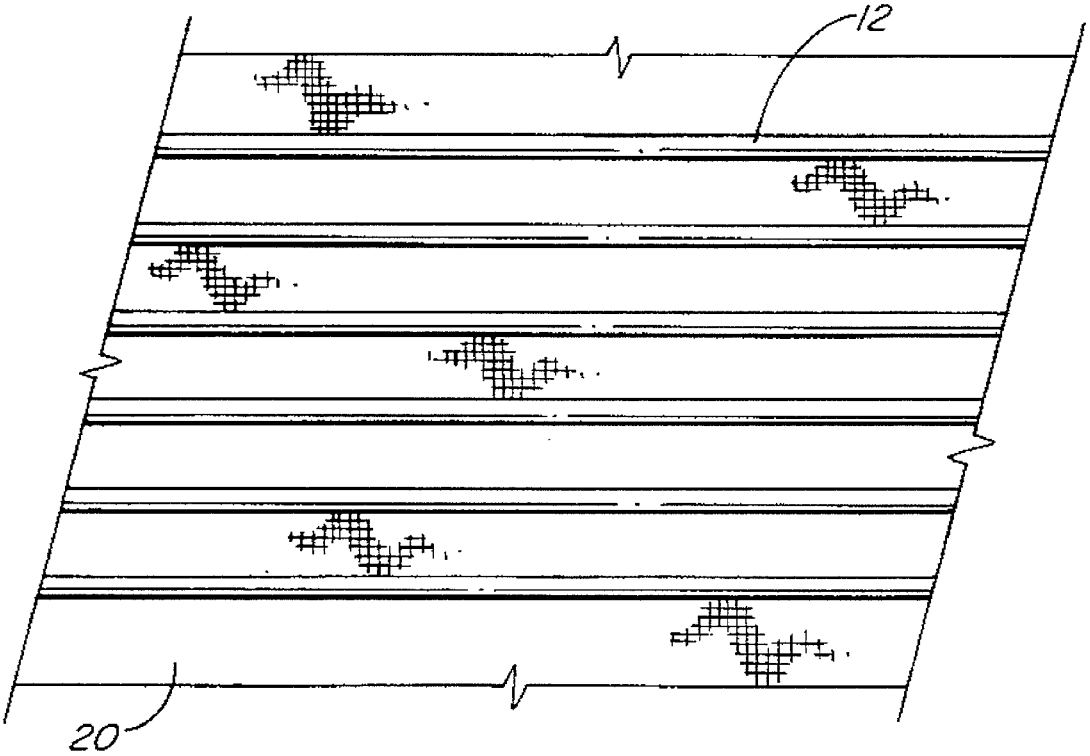
FIG. 3 is a partial side elevational view of the inside surface of an alternative embodiment of a contour skirt of the invention, showing strips of polymer.
Figure 4:
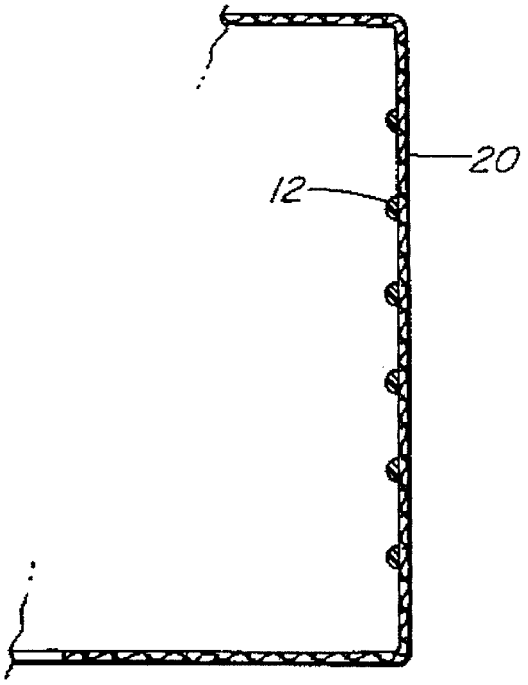
FIG. 4 is a partial cross-sectional view of the alternative embodiment of FIG. 3, showing strips of polymer bonded to the skirt.

FIGS. 3 and 4 show an alternative embodiment of the contour skirt of the invention. In FIGS. 3 and 4, strips of high friction material 12 are shown on the inside surface of the skirting material 20. The strips 12 may be composed of polymers such as latex or neoprene and are approximately ¼ inch to approximately ½ inch wide. The strips shown are generally horizontal and would preferably be between approximately 1 and 2 inches apart. In the manufacturing process, these strips of polymer may be applied to the inside surface of the skirt as a liquid bead and then allowed to dry or cure in place and bond adhesively to the inside surface of the contour skirt. As shown in FIG. 4, these strips 12 may have a raised profile to increase their gripping characteristics.

While the invention has been described in relation to mattress pads and covers, the invention is also useful in application to contoured fitted bed sheets. The only difference in that case from the structure described above is that horizontal pad 3 is simply a rectangular section of bed sheet linen.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A mattress pad or cover for a mattress, said mattress having an upper surface and perpendicular sides, said mattress pad or cover comprising:

a) a top portion sized to cover said upper surface of said mattress, said top portion having a peripheral edge;

b) a continuous fabric skirt depending downwardly from said top portion, said fabric skirt having a lower edge defining an opening adapted for placement of said mattress pad or cover over said mattress, said fabric skirt having an inner surface;

c) a layer of washable polymeric foam attached to said inner surface of said fabric skirt by stitching, said stitching comprising spaced stitch lines generally parallel to said peripheral edge; and, d) means for holding said washable polymeric foam against said perpendicular sides of said mattress when said mattress pad or cover is placed over said mattress.

2. A mattress pad or cover for a mattress, said mattress having an upper surface and perpendicular sides, said mattress pad or cover comprising:

a) a top portion sized to cover said upper surface of said mattress, said top portion having a peripheral edge;

b) a continuous fabric skirt depending downwardly from said top portion, said fabric skirt having a lower edge defining an opening adapted for placement of said mattress pad or cover over said mattress, said fabric skirt having an inner surface;

c) a layer of washable polymeric foam attached to said inner surface of said fabric skirt by stitching, said stitching comprising spaced stitch lines generally parallel to said peripheral edge between approximately one inch to approximately two inches apart; and, d) means for holding said washable polymeric foam against said perpendicular sides of said mattress when said mattress pad or cover is placed over said mattress.

3. A mattress pad or cover for a mattress having an upper surface and perpendicular sides, said mattress pad or cover comprising:

a) a top portion, sized to cover said upper surface of said mattress, said top portion having a peripheral edge;

b) a continuous fabric skirt depending downwardly from said peripheral edge, said fabric skirt having a lower edge, said lower edge of said skirt defining an opening adapted for placement of said mattress pad or cover over said mattress, said skirt having an inner surface;

c) strips of polymer material secured to said inner surface of said skirt for providing increased frictional contact with said perpendicular sides of said mattress, said strips of polymer being generally parallel to said peripheral edge of said top portion and being between approximately 1 inch and approximately 2 inches apart; and, d) means for holding said skirt against said perpendicular sides of said mattress when said mattress pad or cover is placed over said mattress.

4. A mattress pad or cover for a mattress having an upper surface and perpendicular sides, said mattress pad or cover comprising:

a) a top portion sized to cover said upper surface of said mattress, said top portion having a peripheral edge;

b) a continuous fabric skirt depending downwardly from said peripheral edge, said fabric skirt having a lower edge, said lower edge defining an opening adapted for placement of said mattress pad or cover over said mattress, said fabric skirt having an inner surface;

c) a plurality of strips of polymer material secured to said inner surface of said fabric skirt for providing increased frictional contact with said perpendicular sides of said mattress, said strips of polymer being generally parallel to said peripheral edge of said top portion and being between approximately ¼ inch and approximately ½ inch in width; and, d) means for holding said strips of polymer material against said perpendicular sides of said mattress when said mattress pad or cover is placed over said mattress.

5. A mattress pad or cover comprising:

a) a rectangular top portion sized to cover an upper surface of a mattress and having parallel opposed edges;

b) a skirt extending downwardly from said opposed edges and comprising strips of washable polymer material, said polymer material having a co-efficient of friction higher than linen, said strips being secured to an inner surface of said skirt; said strips being approximately 1 inch to 2 inches apart and being generally parallel to said opposed edges of said top portion; and, c) means for holding said strips against said mattress.

* * * * *